US005741066A

United States Patent [19]

Presnell

[11] Patent Number: 5,741,066

[45] Date of Patent: Apr. 21, 1998

[54] HELICAL RIBBON MIXER

[75] Inventor: Dale Presnell, Fort Worth, Tex.

[73] Assignee: Hayes & Stolz Industrial Manufacturing Company Inc., Fort Worth, Tex.

[21] Appl. No.: 840,862

[22] Filed: Apr. 17, 1997

Related U.S. Application Data

[63] Continuation-in-part of Ser. No. 731,329, Oct. 15, 1996, abandoned.

[51] Int. Cl.[6] ..... B01F 7/08

[52] U.S. Cl. ..... 366/320; 366/321

[58] Field of Search ..... 366/64–67, 96–99, 366/102–104, 192–196, 310, 318, 320, 321, 323; 198/662, 669, 676, 677

[56] References Cited

U.S. PATENT DOCUMENTS

| | | | |
|---|---|---|---|
| 1,001,508 | 8/1911 | Craig | 366/320 X |
| 2,687,234 | 8/1954 | McLauchlan et al. | 366/320 X |
| 3,138,167 | 6/1964 | Fisher | 366/320 X |
| 4,634,286 | 1/1987 | Pike | 366/320 |
| 4,941,132 | 7/1990 | Horn et al. | 366/300 X |
| 5,144,892 | 9/1992 | Tupek et al. | 366/320 X |
| 5,228,775 | 7/1993 | Horn et al. | 366/320 X |

FOREIGN PATENT DOCUMENTS

| | | | |
|---|---|---|---|
| 2520909 | 12/1975 | Germany | 366/320 |

*Primary Examiner*—Charles E. Cooley
*Attorney, Agent, or Firm*—Arthur F. Zobal

[57] ABSTRACT

The mixer has a chamber with a shaft supported for rotation along an axis along the length of the chamber. Two sets of outer ribbon members are coupled to the shaft such that the two set of outer ribbon members are located about 180 degrees apart and extend helically around the shaft. Two sets of inner ribbon members are coupled to the shaft such that the two sets of inner ribbon members are located about 180 degrees apart and extend helically around the shaft. A drive is coupled to the shaft for rotating the shaft and hence the ribbon members about the axis. The two sets of outer ribbon members are located radially outwardly of the two sets of inner ribbon members. Each set of outer ribbon members has at least two radially spaced apart outer ribbon members. Each set of inner ribbon members has at least two radially spaced apart inner ribbon members. One of the two sets of ribbon members has a left hand pitch and the other of the two sets of outer ribbon members has a right hand pitch.

6 Claims, 10 Drawing Sheets

PLAN VIEW

PLAN VIEW

HELICAL RIBBON MIXER

SPECIFICATION

This application is a continuation-in-part of U.S. patent application Ser. No. 08/731,329, filed Oct. 15, 1996, now abandoned.

BACKGROUND OF THE INVENTION

1. Field of the Invention

The invention relates to a mixer for mixing for blending particulate solids in the dry state or with liquid addition.

2. Description of the Prior Art

Conventional mixing machines for mixing or blending particulate solids have taken various forms and have utilized various mechanical apparatuses to affect comingling of ingredients placed therein. The term mixing, however, has recently come to infer that a certain relationship by volume of each of the ingredients of the total mixer charge also exists in random samples taken from the mixed product batch. Since most of the prior art of mixers have not been able to provide absolute perfection, most users of such equipment have adopted standards to express the accuracy of their specific mixing machines. Such standards usually utilize statistical formulae. In a similar manner, the requirements of todays mixing machines have been dictated with respect to the power consumed by the mixing operation.

Thus, the problem areas of the prior art mixers are the speed and accuracy of mixing and the power requirements.

Some of the known mixers use inner and outer helical ribbons coupled to a rotatable shaft as shown in FIGS. 6 and 7 of U.S. Pat. No. 4,941,132.

Another known mixer was two split inner helical ribbons and one outer helical ribbon.

SUMMARY OF THE INVENTION

It is an object of the invention to provide a mixer for mixing solid particulates in the dry form or with liquid addition at a short mix time and with minimal power requirements.

The mixer of the invention comprises a chamber having a given length, width, and height for receiving particulate material to be mixed. The chamber has first and second spaced apart side walls, a bottom wall and first and second spaced apart end walls, with the distance between said first and second end walls defining the length. A shaft is supported for rotation along an axis which extends between the first and second end walls. Two sets of outer ribbon members are coupled to the shaft such that they are located about 180 degrees apart and extend helically around the shaft along a substantial portion of the length of the shaft. Two sets of inner ribbons are coupled to the shaft such that they are located about 180 degrees apart and extend helically around the shaft along a substantial portion of the length of the shaft. Drive means is coupled to said shaft for rotating the shaft and hence the ribbon members about the axis. The two sets of outer of ribbon members are located radially outwardly of the two sets of inner ribbon members. Each set of outer ribbon members comprises at least two spaced apart outer ribbon members each having a given thickness and a given width with the widths of said outer ribbon members on each side of said shaft being aligned generally radially. Each set of inner ribbon members comprises at least two spaced apart inner ribbon members each having a given thickness and a given width with the widths of the inner ribbon members on each side of said shaft being aligned generally radially. One of the two sets of ribbon members has a left hand pitch and the other of the two sets of outer ribbon members has a right hand pitch.

Figure 1:
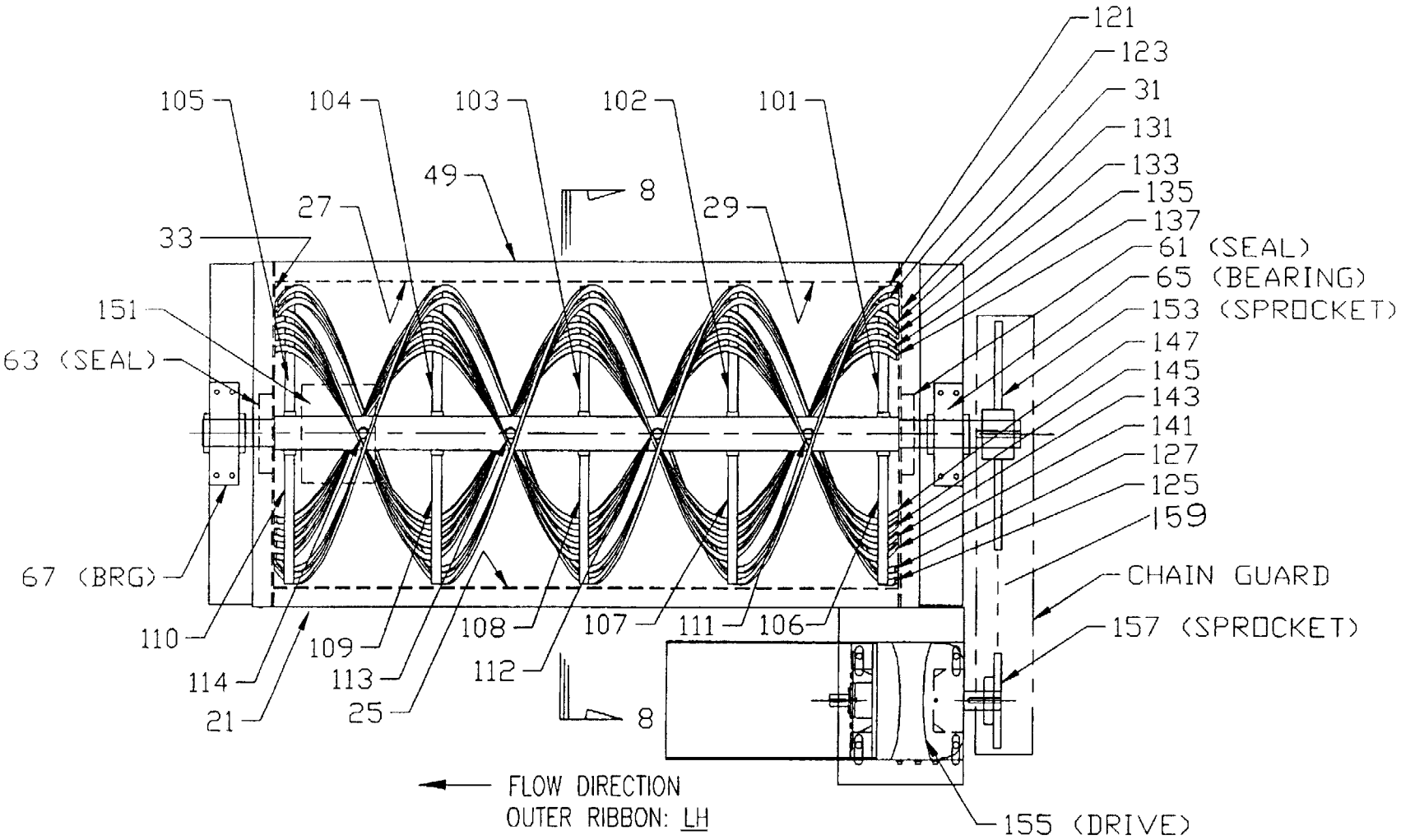
FIG. 1 is a plan view of the mixer of the invention with the top removed.
Figure 2:
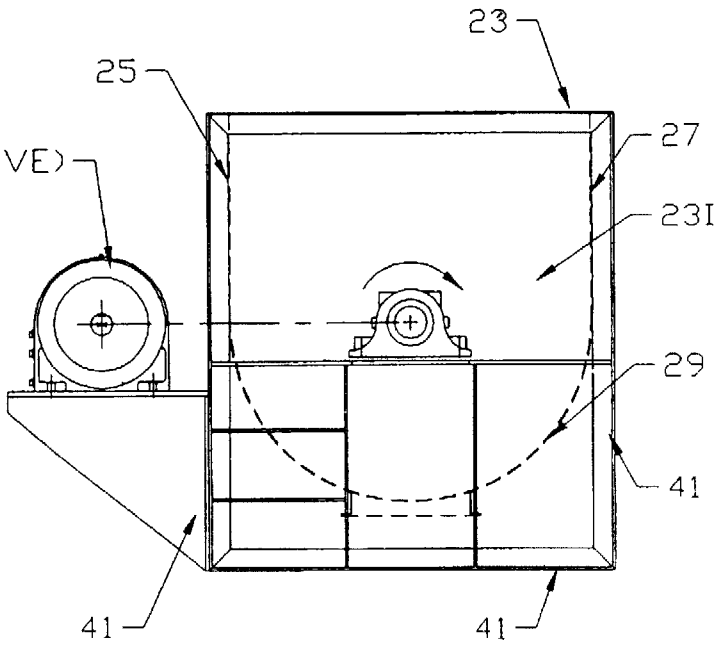
FIG. 2 is an end view of FIG. 1 as seen from the drive end.
Figure 3:
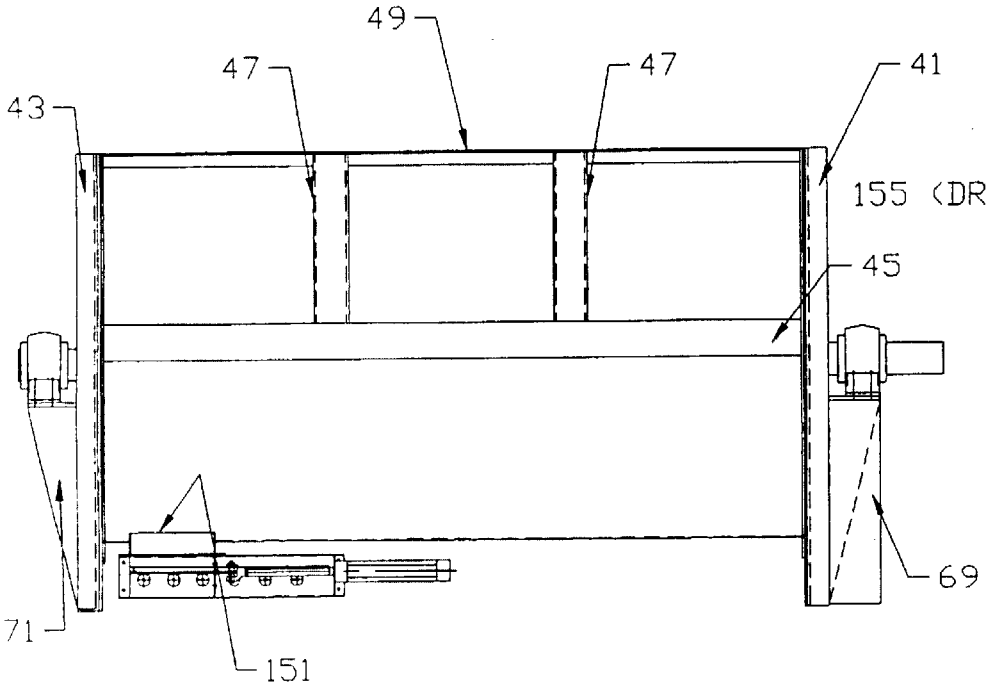
FIG. 3 is a side view of FIG. 1 with the drive removed.
Figure 4:
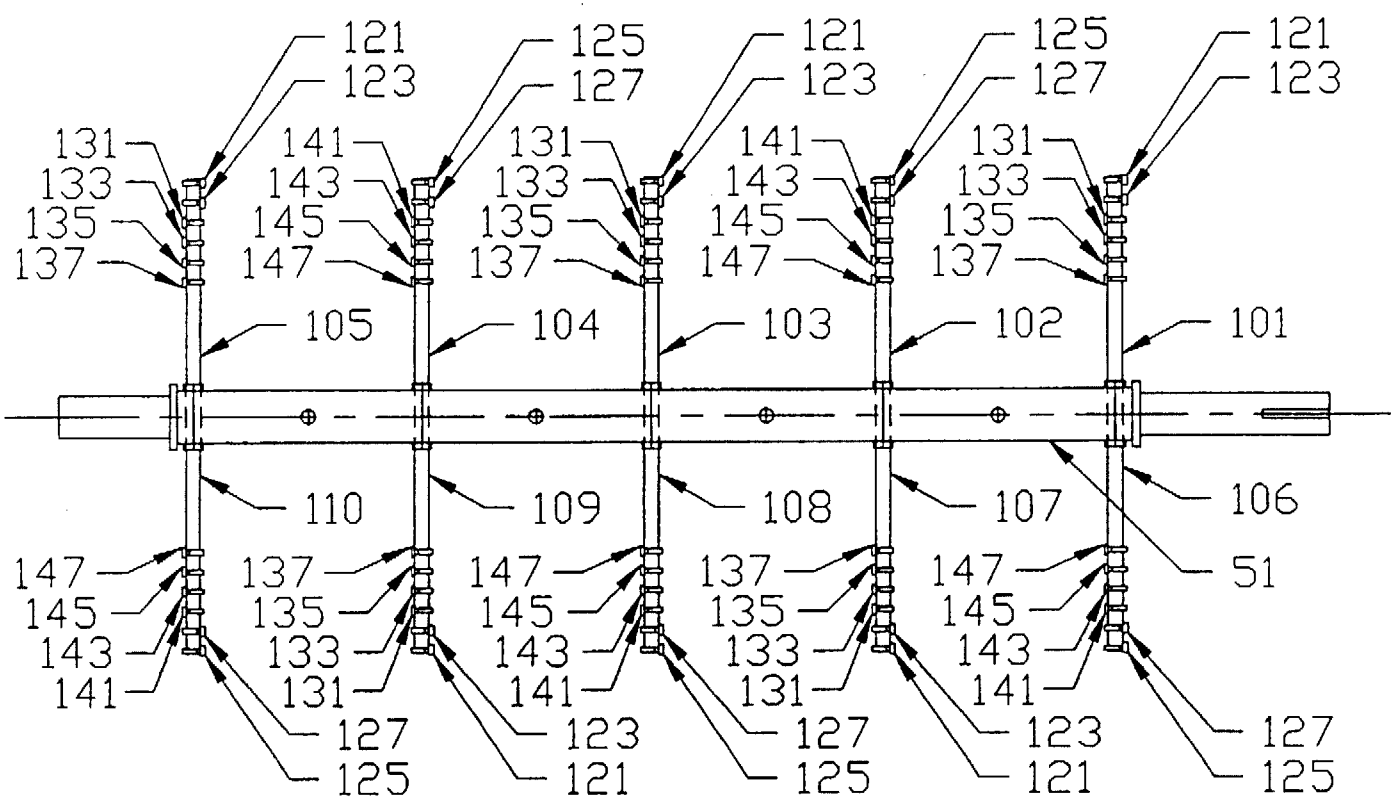
FIG. 4 illustrates the shaft of the mixer with 10 of its spokes and only portions of the ribbons connected to the spokes.
Figure 5:
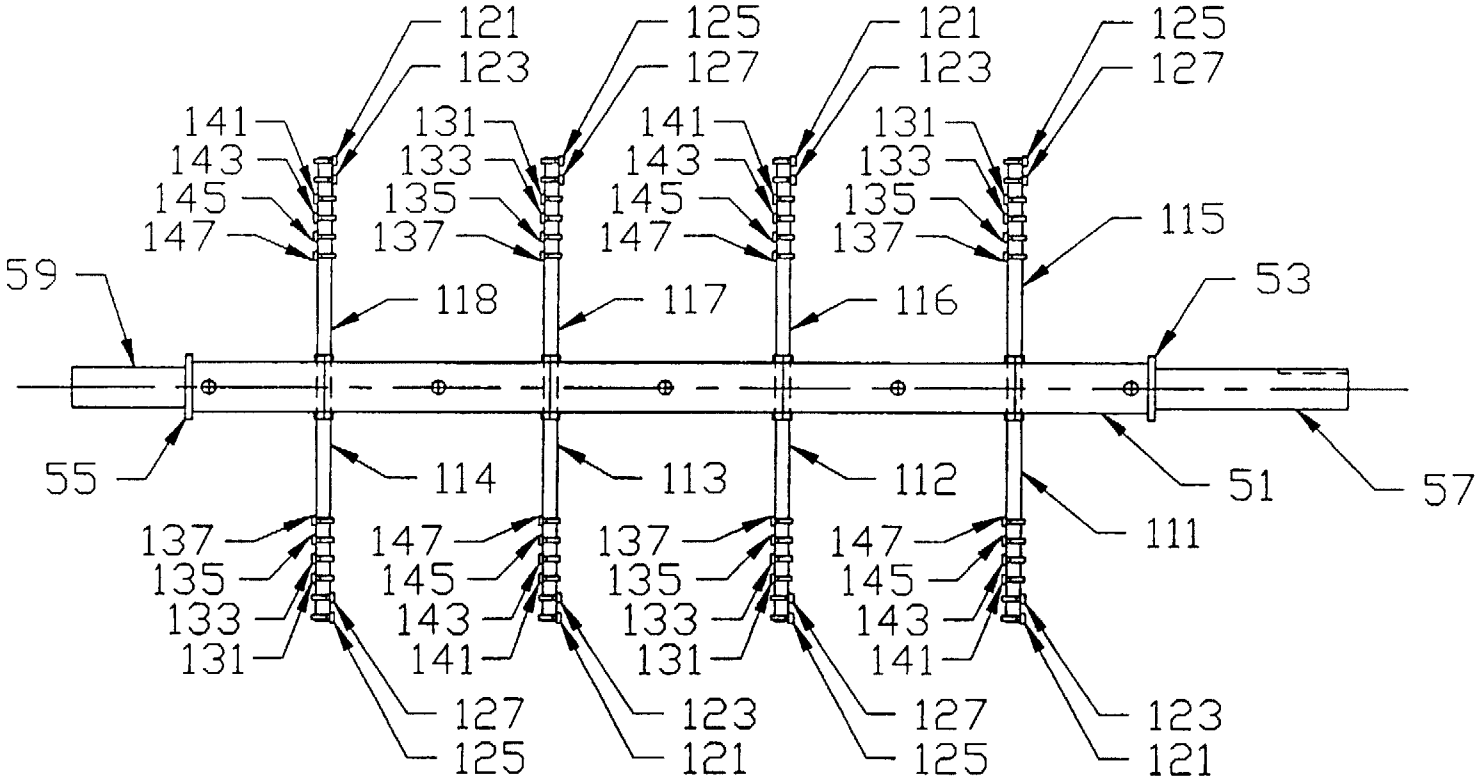
FIG. 5 illustrates the shaft of FIG. 4 rotated 90 degrees from that shown in FIG. 4 with 8 of its spokes transverse to those of FIG. 4 and only portions of its ribbons connected to the spokes.

The mixer of FIGS. 10, 11, 12, 13, and 14 is the same as that of FIGS. 1–8 except that the spokes are located behind the ribbons with respect to the direction of flow of the material being mixed in the chamber.

DESCRIPTION OF THE PREFERRED EMBODIMENTS

Referring now to the drawings, the mixer of the invention is identified by reference numeral 21. It comprises a chamber 23 having side walls 25 and 27 which form a continuation of a half round bottom wall 29 and two end walls 31 and 33 all of which are formed of suitable metal. The walls 25, 27, 29, 31, and 33 are supported by end support structure 41, 43, and side support structure 45, 47, and 49 on each side of the mixer.

A rotatable shaft 51 formed of suitable metal extends through the interior 23I of the chamber 23. The shaft 51 has collars 53 and 55 at its ends with smaller cross-sectional size extensions 57 and 59 which extend through the end walls 31 and 33 respectively. Members 61 and 63 are seals and members 65 and 67 are pillow block bearings supported by exterior structure 69 and 71. The bearings 65 and 67 support the shaft 51 for rotation.

Five spokes 101,102, 103, 104, 105 are secured to one side of the shaft 51 in a first plane and five spokes 106, 107, 108, 109, 110 are secured to the opposite side of the shaft in the same first plane, with spokes pairs 101,106; 102, 107; 103, 108; 104, 109; and 105 110 being in alignment. Four spokes 111, 112, 113, 114 are secured to the shaft in a second plane 90° from the first plane and four spokes 115, 116, 117, 118 are secured to the shaft on the opposite side of spokes 111–114 in the second plane with spoke pairs 111, 115; 112, 116; 113, 117; 114, 118 being in alignment. Spoke pairs 111, 115 are on the shaft located midway between spoke pairs 101, 106 and 102, 107. Spoke pairs 112, are located on the shaft midway between spoke pairs 102, 107 and 103, 108. Spoke pairs 113, 117 are located on the shaft midway between spoke pairs 103, 108 and 104, 109. Spoke pairs 114, 118 are located on the shaft midway between spoke pairs 104, 109 and 105, 110.

A first set of radially spaced apart outer metal ribbons 121, 123 are connected to selected ones of the spokes such that they extend helically around the shaft 51. A second set of radially spaced apart outer metal ribbons 125 and 127 are connected to selected ones of the spokes such that they extend helically around the shaft 51. Ribbons 121, 123 start 180° from the start of ribbons 125 and 127 from the drive end. Both sets 121, 123 and 125, 127 have a left hand pitch with the shaft rotating clockwise as seen from the drive end looking toward the discharge end.

A first set of radially spaced apart inner metal ribbons 131, 133, 135, 137 are connected to selected ones of the spokes such that they extend helically around the shaft 51. A second set of radially spaced apart inner metal ribbons 141, 143, 145, 147 are connected to selected ones of the spokes such that they extend helically around the shaft 51. Ribbons 131, 133, 135, 137 start 180° from the start of ribbons 141, 143, 145, 147 from the drive end. Both sets 131, 133, 135, 137 and 141, 143, 135, 137 have a right hand pitch with the shaft rotating clockwise as seen from the drive end looking toward the discharge end.

Ribbons 121, 123 are connected to the outer ends of spokes 101, 111, 107, 116, 103, 113, 109, 118, and 105.

Ribbons 125, 127 are connected to the outer ends of spokes 106, 115, 102, 112, 108, 117, 104, 114, 110.

Ribbons 131, 133, 135, 137 are connected to spokes 101, 115, 107, 112, 103, 117, 109, 114, 105.

Ribbons 141, 143, 145, 147 are connected to spokes 106, 111, 102, 116, 108, 113, 104, 118, 110.

Figure 6:
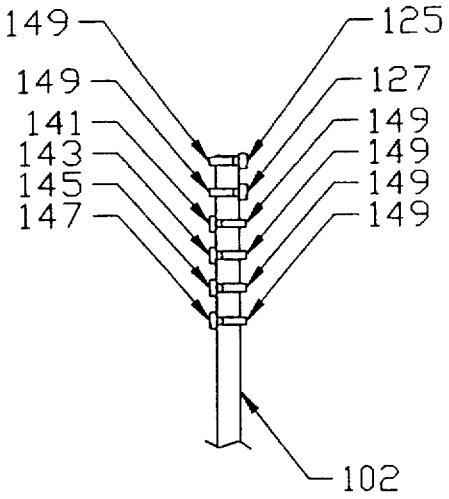
FIG. 6 is an enlarged view of one of the spokes of FIG. 5.
Figure 7:
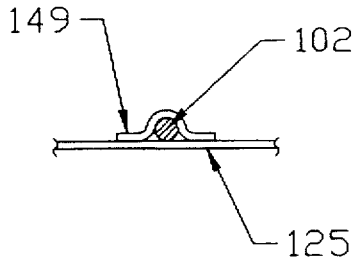
FIG. 7 illustrates in more detail the connection of a ribbon to a spoke.
Figure 8:
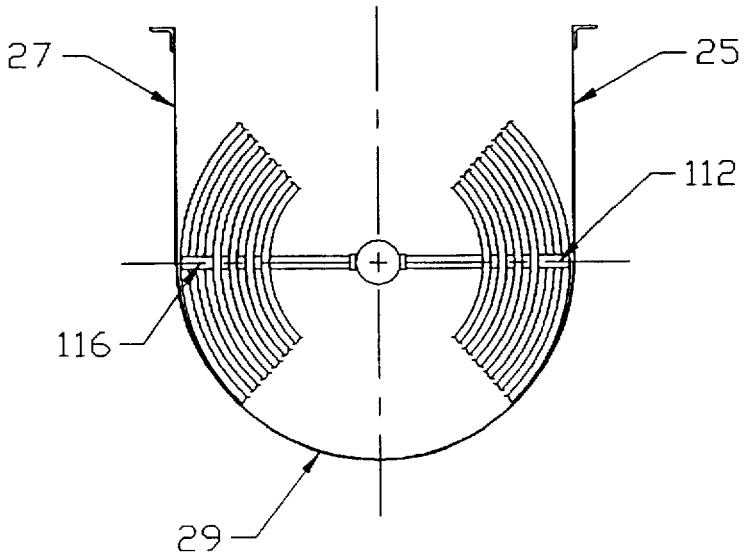
FIG. 8 is a cross-section of FIG. 1 taken along the lines 8—8 thereof showing only part of the ribbons.

Referring to FIGS. 6 and 7, the ribbons 125, 127, 141, 143, 145, are shown connected to appropriate sides of spoke 102 with the use of metal straps 149 (See FIG. 7) which are welded to the spoke and to the ribbons with the ribbons also being welded to the spoke. All of the ribbons are connected to the appropriate spokes in the same manner.

In one embodiment the ribbons each have a width of 1 inch and a thickness of ½ of an inch and adjacent ribbons are spaced 1 inch apart radially.

The chamber 21 has a controllable discharge mechanism 151 formed in the bottom wall 29 near the end 33. The discharge 151 may be a flat slide gate operated by an air cylinder. The drive end 57 of the shaft has a sprocket 153 attached thereto. An electric motor drive mechanism 155 is provided for rotating a sprocket 157. A chain 159 is coupled to sprockets 157 and 153 such that when the motor 155M is operated, to rotate the sprocket 157, sprocket 153 is rotated to rotate the shaft 51 and hence the helical ribbons in a clockwise direction as seen from the drive end 31 looking toward the discharge end 33.

As the ribbons are rotated, they move through the particulate material and the outer ribbons move the particulate matter toward the discharge end 33 and the inner ribbons move the particulate material away from the discharge end toward the drive end 31 for mixing purposes. The radially split ribbons create more shear action in moving through the particulate material and creates a secondary mixing action. In this respect, as the material moves through the split ribbons, a turbulence is created behind the ribbons resulting in better and faster mixing action.

Figure 9:
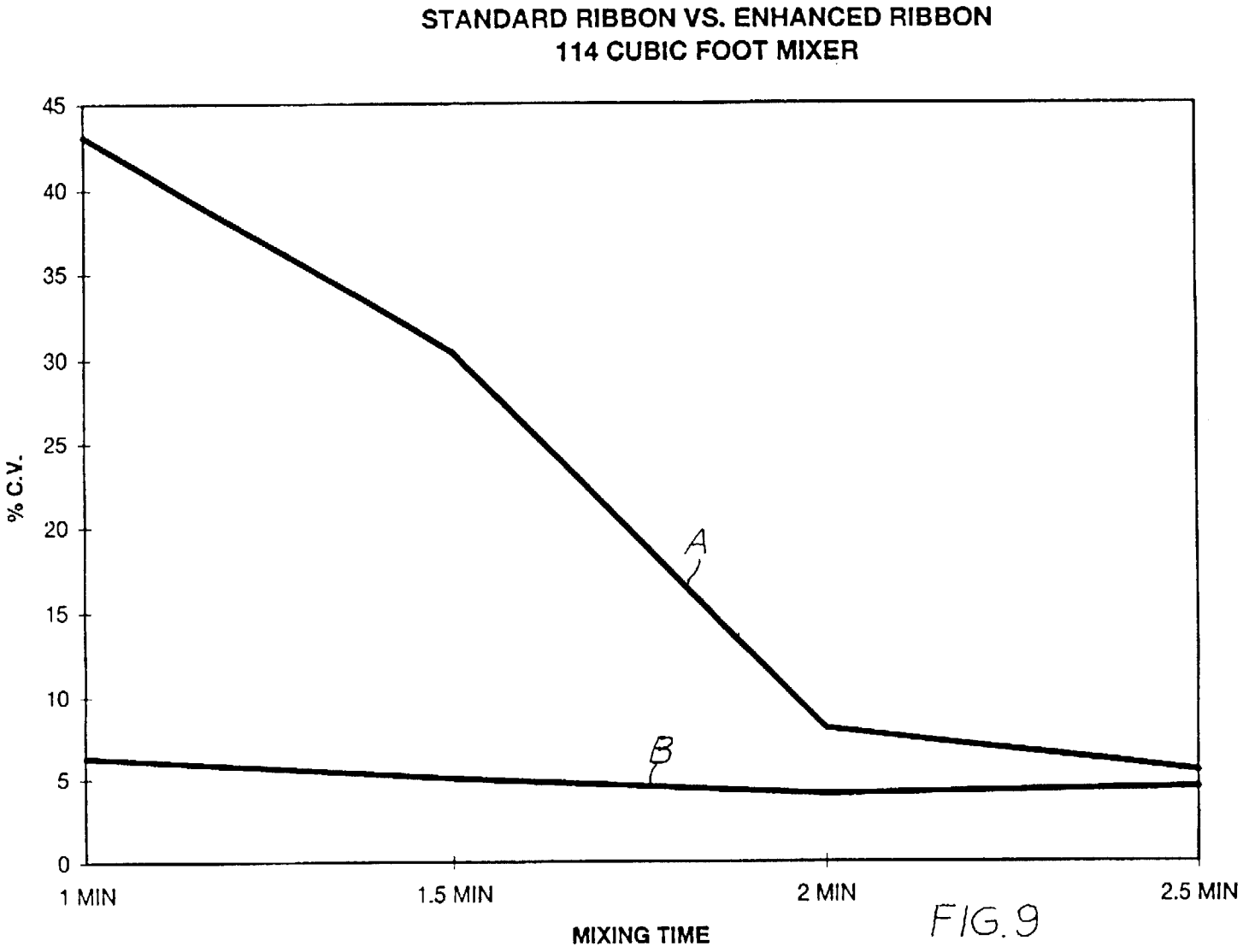
FIG. 9 are two curves showing the percentage of coefficient of variation versus mixing time of a standard ribbon mixer and the ribbon mixer of the invention.
Figure 10:
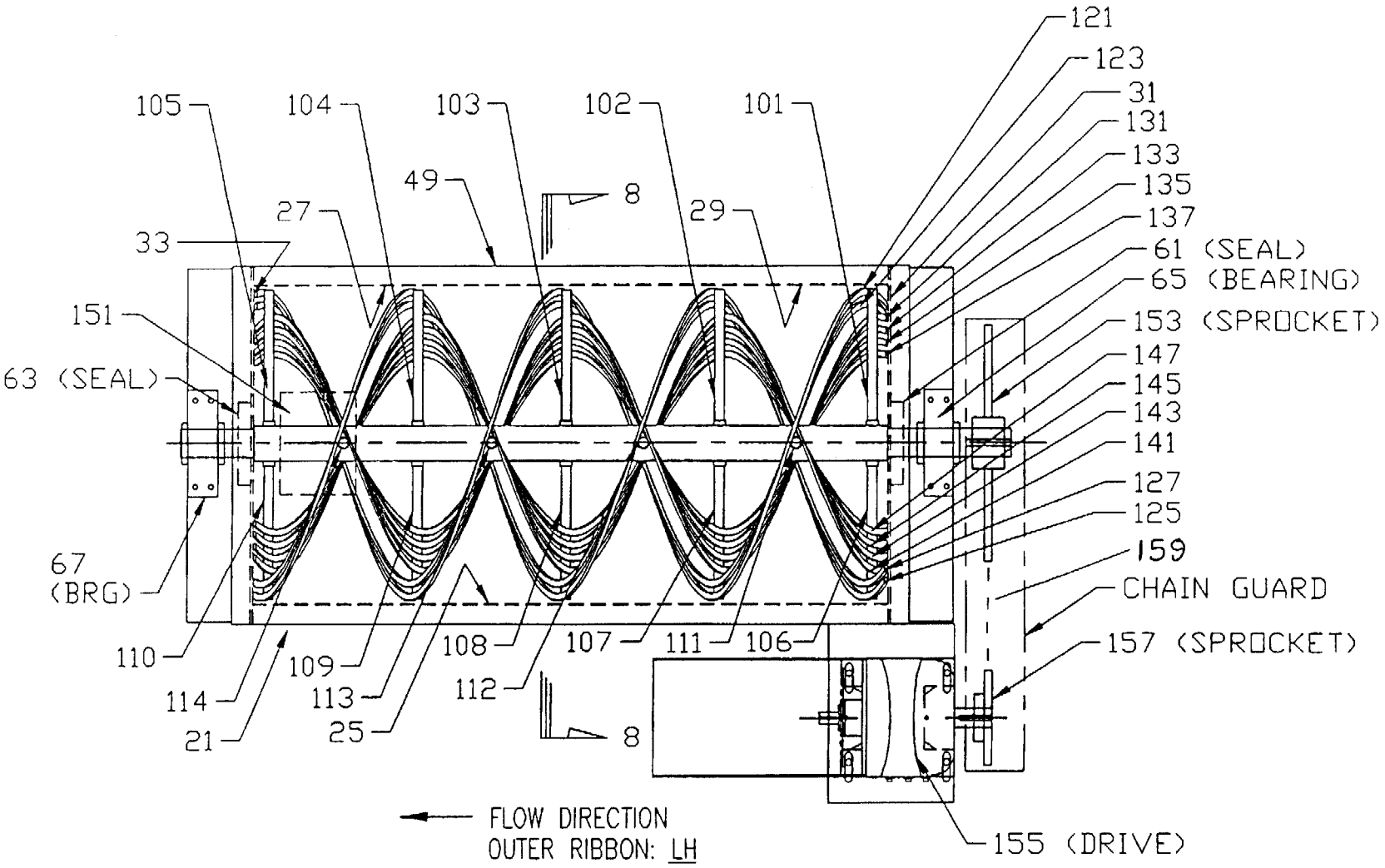
Figure 11:
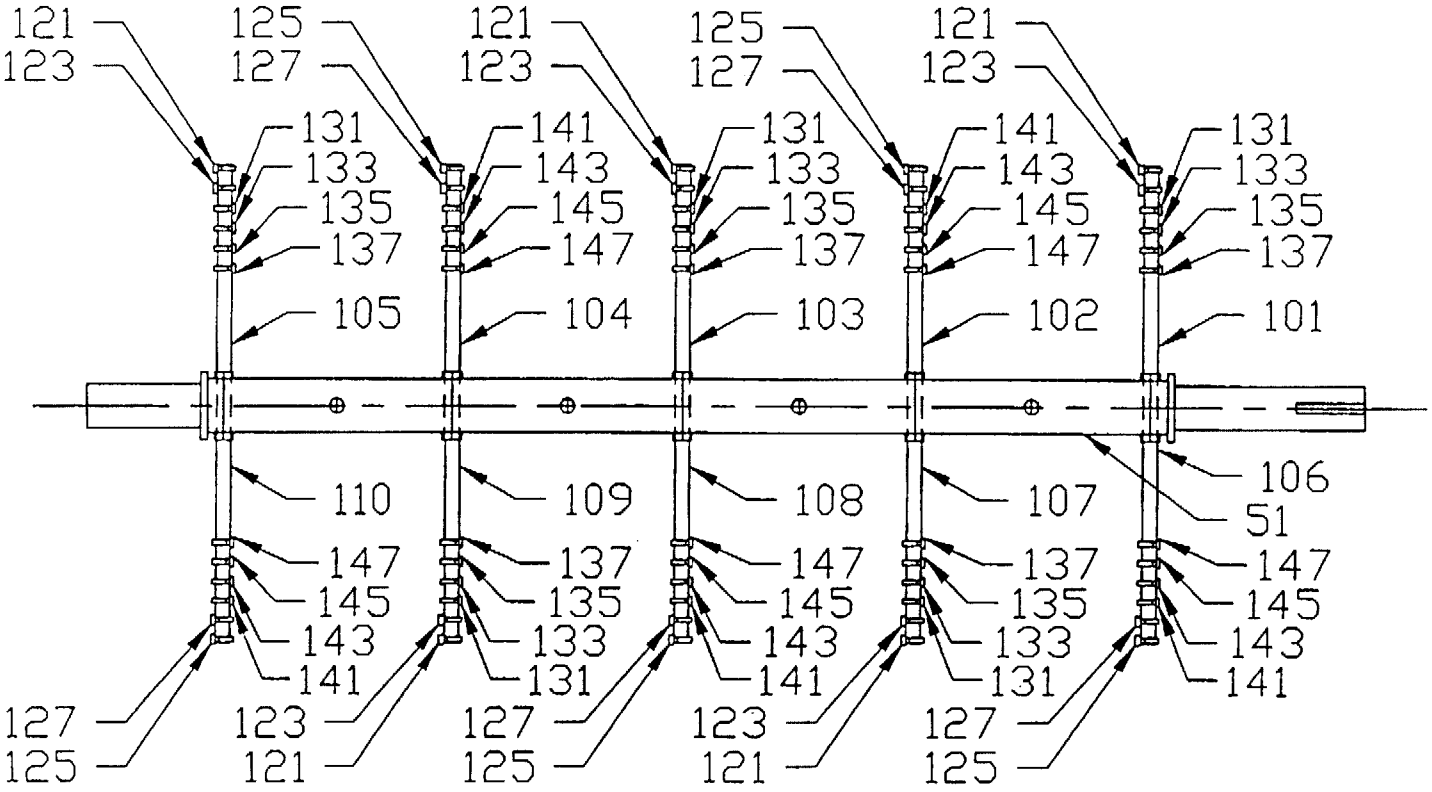
Figure 12:
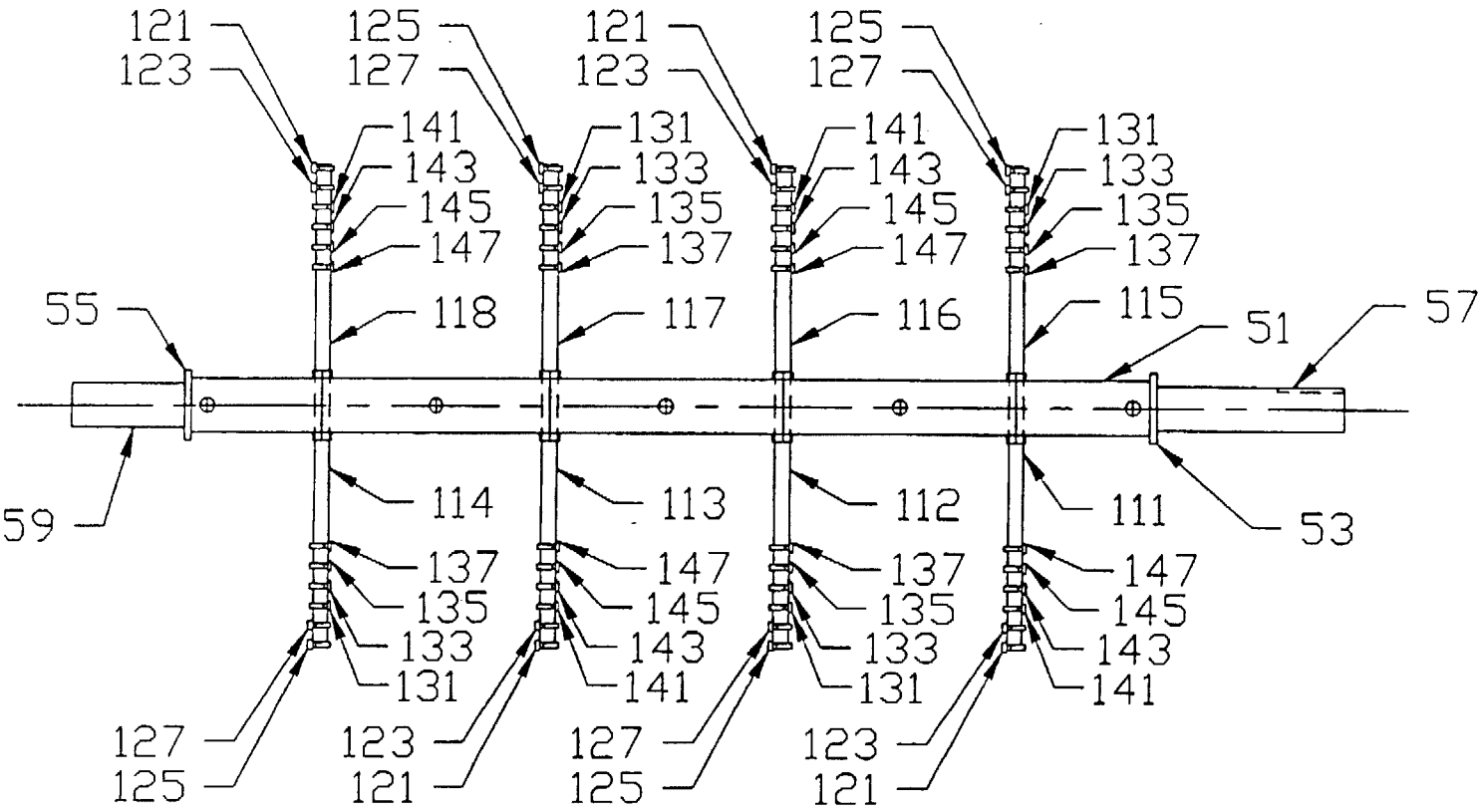
Figure 13:
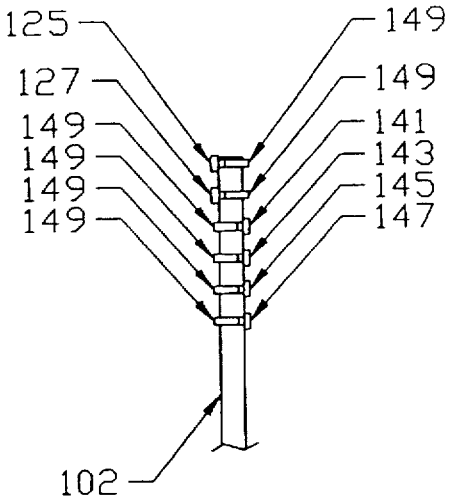
Figure 14:
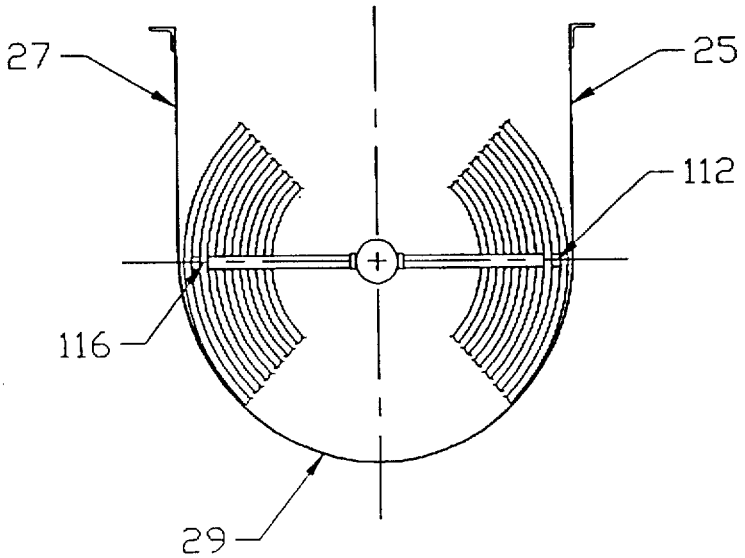

Referring to FIG. 9, curve A represents the percentage of coefficient of variation of a standard ribbon mixer and curve B represents the percentage of coefficient of variation of the ribbon mixer of the invention. As shown the coefficient began below 10 at about one minute of operation of the mixer of the invention when mixing ground corn and salt for test purposes to determine if the salt is evenly distributed throughout the mix.

There will be at least two ribbon members for each inner ribbon set and at least two ribbon members for each outer ribbon set. For example each inner ribbon set may have two, three, four, five, six or more ribbons and each outer ribbon set may have two, three, four, or more ribbons. Generally there will be more ribbons for the inner ribbon sets than for the outer ribbon sets since the outer ribbons will move at a faster peripheral speed than the inner ribbons.

The inner ribbons are designed based on the load that the outer ribbons are intended to carry. In order to balance the load in one case, it was found desirable to remove one of the ribbons of one of the sets of inner ribbons. In this example, ribbon 147 was removed.

In one embodiment, the chamber bottom has an inside diameter of 52 inches and the maximum diameter of the outer ribbons is 51 inches. The chamber has an inside length of 104 inches. The peripheral speed of the outer ribbons may be of the order 330 feet per minute such that the rotational speed of the shaft may be of the order of 16 to 30 RPM depending on the size of the mixer. It is to be understood that these dimensions and RPMS may vary.

As an alternative the outer ribbons 121, 123 and 125, 127 may have a right hand pitch and the inner ribbons 131, 133, 135, 137 and 141, 143, 145, 147 may have a left hand pitch with the shaft rotating clockwise as seen from the drive end if the discharge 151 is located at the drive end 31.

The mixer of the invention may be used to mix different types of grains, powdered materials such as flour, etc.

In FIGS. 10–14, the spokes are located behind the ribbons with respect to the direction of flow of the material being mixed in the chamber. This is preferred since the spokes in this embodiment will not interfere with the flow of material across the ribbons on their forward sides.

I claim:

1. An apparatus for mixing particulate materials, comprising:

a chamber having a given length, width, and height for receiving particulate material to be mixed, said chamber having first and second spaced apart side walls, a bottom wall and first and second spaced apart end walls, the distance between said first and second end walls defining said length, a shaft supported for rotation along an axis which extends between said first and second end walls, two sets of outer ribbon members coupled to said shaft such that said two sets of outer ribbon members are located about 180 degrees apart and extend helically around said shaft along a substantial portion of the length of said shaft, two sets of inner ribbon members coupled to said shaft such that said two sets of inner ribbon members are located about 180 degrees apart and extend helically around said shaft along a substantial portion of the length of said shaft, drive means coupled to said shaft for rotating said shaft and hence said ribbon members about said axis, said two sets of outer ribbon members being located radially outwardly of said two sets of inner ribbon members and spaced radially from said two sets of inner ribbon members, each set of outer ribbon members comprising at least two spaced apart outer ribbon members each having a given thickness and a given width with said widths of said outer ribbon members on each side of said shaft being generally aligned radially.

each set of inner ribbon members comprising at least two spaced apart inner ribbon members each having a given thickness and a given width with said widths of said inner ribbon members on each side of said shaft being generally aligned radially.

one of said two sets of ribbon members having a left hand pitch and the other of said two sets of ribbon members having a right hand pitch.

2. The apparatus of claim 1, wherein:

each set of inner ribbon members has more ribbon members than each set of outer ribbon members.

3. The apparatus of claim 2, wherein:

each set of inner ribbon members has four spaced apart inner ribbon members.

4. An apparatus for mixing particulate materials, comprising:

a chamber having a given length, width, and height for receiving particulate material to be mixed, said chamber having first and second spaced apart side walls, a bottom wall and first and second spaced apart end walls, the distance between said first and second end walls defining said length, a shaft supported for rotation along an axis which extends between said first and second end walls, two sets of outer ribbon members coupled to said shaft such that said two sets of outer ribbon members are located about 180 degrees apart and extend helically around said shaft along a substantial portion of the length of said shaft, two sets of inner ribbon members coupled to said shaft such that said two sets of inner ribbon members are located about 180 degrees apart and extend helically around said shaft along a substantial portion of the length of said shaft, drive means coupled to said shaft for rotating said shaft and hence said ribbon members about said axis, said two sets of outer ribbon members being located radially outwardly of said two sets of inner ribbon members and spaced radially from said two sets of inner ribbon members, each set of outer ribbon members comprising at least two spaced apart outer ribbon members generally aligned radially, each set of inner ribbon members comprising at least two spaced apart inner ribbon members generally aligned radially, one of said two sets of ribbon members having a left hand pitch and the other of said two sets of ribbon members having a right hand pitch.

5. The apparatus of claim 4, wherein:

each set of inner ribbon members has more ribbon members than each set of outer ribbon members.

6. The apparatus of claim 5, wherein:

each set of inner ribbon members has four spaced apart inner ribbon members.

* * * * *